US006433526B2

(12) United States Patent
Micheli

(10) Patent No.: US 6,433,526 B2
(45) Date of Patent: Aug. 13, 2002

(54) REGULATING DEVICE FOR RECEIVING A VARIABLE VOLTAGE AND DELIVERING A CONSTANT VOLTAGE AND RELATED METHODS

(75) Inventor: Laurent Micheli, Crolles (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 09/750,612

(22) Filed: Dec. 28, 2000

(30) Foreign Application Priority Data

Dec. 29, 1999 (FR) ..... 99 16674

(51) Int. Cl.[7] ..... G05F 1/40; G05F 1/44; G05F 1/56

(52) U.S. Cl. ..... 323/284; 323/274; 323/303

(58) Field of Search ..... 323/266, 274, 323/282, 284, 299, 303

(56) References Cited

U.S. PATENT DOCUMENTS

| | | | | |
|---|---|---|---|---|
| 4,580,090 A | * | 4/1986 | Bailey et al. | 323/303 |
| 4,731,574 A | * | 3/1988 | Melbert | 323/275 |
| 4,899,098 A | | 2/1990 | Gariboldi | 323/277 |
| 5,047,751 A | | 9/1991 | Miura et al. | 340/661 |
| 5,570,004 A | * | 10/1996 | Shibata | 323/303 |
| 5,686,821 A | * | 11/1997 | Brokaw | 323/273 |
| 5,955,870 A | * | 9/1999 | Nair | 323/273 |
| 6,084,385 A | * | 7/2000 | Nair | 323/273 |
| 6,218,821 B1 | * | 4/2001 | Bisbee | 323/299 |
| 6,262,567 B1 | * | 7/2001 | Bartlett | 323/303 |

FOREIGN PATENT DOCUMENTS

| | | | |
|---|---|---|---|
| DE | 4337229 | 11/1994 | G05F/1/569 |
| DE | 19739246 | 3/1999 | G05F/1/569 |
| EP | 0756222 | 1/1997 | G05F/1/569 |

* cited by examiner

*Primary Examiner*—Bao Q Vu
(74) *Attorney, Agent, or Firm*—Lisa K. Jorgenson; Allen, Dyer, Doppelt, Milbrath & Gilchrist, P.A.

(57) ABSTRACT

A regulating device for receiving a variable voltage and delivering a constant voltage includes a regulating element that includes a circuit for comparing the variable voltage with a reference voltage, a circuit for dividing the variable voltage by a factor, and a switching circuit for supplying the regulating element with a voltage equal either to the variable voltage or to the divided variable voltage. The switching circuit may be controlled by the comparison circuit in such a way that the regulating element is supplied with the variable voltage if a voltage condition is not satisfied and with the divided variable voltage if the voltage condition is satisfied.

22 Claims, 3 Drawing Sheets

REGULATING DEVICE FOR RECEIVING A VARIABLE VOLTAGE AND DELIVERING A CONSTANT VOLTAGE AND RELATED METHODS

FIELD OF THE INVENTION

The present invention relates to the field of voltage regulators, and, more particularly, to voltage regulators of a type delivering a constant DC voltage while being supplied with a DC voltage prone to variation.

BACKGROUND OF THE INVENTION

Conventionally, a regulator which is required to output a voltage of 3.3 volts will be supplied with a DC voltage of about 5.1 to 9.5 volts. The upper limit of supply of a regulator depends essentially on the technology of the active components with which it is provided.

SUMMARY OF THE INVENTION

An object of the present invention is to provide a voltage regulator which is not damaged when the voltage to which it is subjected exceeds the breakdown voltage of its active components.

A regulating device according to present the invention is supplied with a variable voltage $V_v$ and delivers a constant voltage for supplying consumer elements. The device may include a regulating element, a means or circuit for comparing the variable voltage $V_v$ with a reference voltage $V_{ref}$, a means or circuit for dividing the variable voltage $V_v$ by a factor $k_1$, and a switching means or circuit able to supply the regulating element with a voltage $V_r$ equal either to the variable voltage $V_v$, or to the divided variable voltage $V_v/k_1$. The switching means may be controlled by the comparison means in such a way that the regulating element is supplied with the variable voltage $V_v$ if a voltage condition is satisfied and with the divided variable voltage $V_v/k_1$ if the voltage condition is not satisfied. This is because the variable voltage $V_v$ is prone to take values greater than those which the active components of the device are capable of supporting.

Advantageously, the comparison means may include a means or circuit for dividing the variable voltage $V_v$ by a factor $k_2$ to obtain a comparison voltage $V_{comp}=V_v/k_2$, and an amplifier arranged as a comparator receiving on one input the comparison voltage $V_{comp}$ and on another input the reference voltage $V_{ref}$ to output a control signal $V_+$. The control signal $V_+$ may be of a conventional value 1 if the comparison voltage $V_{comp}$ is greater than the reference voltage $V_{ref}$ and of a conventional value 0 if the comparison voltage $V_{comp}$ is less than the reference voltage $V_{ref}$.

The device may include an inverter at the output of the amplifier to obtain an inverse control signal $V_-$. The means for dividing by the factor $k_2$ may include at least two resistors arranged in series between the variable voltage $V_v$ and ground. The means for dividing by the factor $k_1$ may include at least two resistors arranged in series between the variable voltage $V_v$ and ground. The means for dividing by the factor $k_1$ and the means for dividing by the factor $k_2$ may include at least one common resistor.

Advantageously, the switching means may include a first transistor, one terminal of which is connected to the input of the switching means and sees the variable voltage $V_v$. Another terminal of the first transistor is connected to the output of the switching means and sees the voltage $V_r$. A control terminal of the first transistor is linked to a control means or circuit generating a voltage able to turn on the first transistor if the voltage condition is not satisfied or to turn off the transistor if the voltage condition is satisfied. The first transistor may be a MOS transistor.

The switching means may also include at least one second transistor, one terminal of which is connected to the input of the switching means and sees the variable voltage $V_v$. Another terminal of the second transistor is connected to the output of the switching means and sees the voltage $V_r$. Furthermore, a control terminal of the second transistor sees a control voltage equal to the divided variable voltage $V_v/k_1$ that is able to turn off the second transistor if the voltage condition is not satisfied and to turn on the second transistor if the voltage condition is satisfied. Thus, the voltage $V_r$ is equal to the divided variable voltage $V_v/k_1$. The second transistor may be replaced by a cascode arrangement of several transistors, for example bipolar transistors, to deliver more current at the output of the switching means.

Advantageously, the means for controlling the first transistor may include a third transistor controlled by an output voltage from the comparison means and a fourth transistor controlled by the inverse of the output voltage from the comparison means. The third transistor may be connected at one terminal to ground and at another terminal to the output of the switching means seeing the voltage $V_r$ by way of two resistors R21 and R22 in series. A common point shared by the two resistors sees the voltage $V_r$ if the voltage condition is not satisfied and a voltage equal to $V_r$*R21/(R21+R22) if the voltage condition is satisfied.

The fourth transistor may be connected by one terminal to ground and by another terminal to the output of the switching means by a fifth transistor whose control terminal is connected to the common point shared by the two resistors. The fifth transistor may be on if the voltage condition is satisfied and off if the voltage condition is not satisfied so that the common point shared by the fourth and fifth transistors sees a voltage which is substantially 0 if the voltage condition is not satisfied and substantially equal to the voltage $V_r$ if the voltage condition is satisfied. The third and fourth transistors may be MOS transistors with their sources connected to ground. The fifth transistor may also be a MOS transistor with a source connected to the voltage $V_r$.

Advantageously, the means for controlling the first transistor may furthermore include a sixth transistor having a terminal connected to the common point shared by the fourth and fifth transistors. The other terminal and the control terminal of the sixth transistor may be short circuited and linked to the output of the switching means seeing the voltage $V_r$ by two resistors R27 and R28 in series. The sixth transistor may be on if the voltage condition is not satisfied and off if the voltage condition is satisfied. The common point shared by the two resistors R27 and R28 sees the voltage $V_r$*R27/(R27+R28) if the voltage condition is not satisfied and the voltage $V_r$ if the voltage condition is satisfied.

A seventh transistor is provided with a control terminal connected to the common point shared by the two resistors R27 and R28. A terminal thereof may be connected to the common point shared by the fourth and fifth transistors. Another terminal of the seventh transistor may be connected to the common point shared by the fourth and fifth transistors by a resistor R33. Also, the remaining terminal of the seventh transistor may be connected to the control terminal of the first transistor of the switching means by a resistor R32. A resistor R31 links the control terminal of the first transistor and the input of the switching means which sees the variable voltage $V_v$.

This is done in such a way that the seventh transistor is on if the voltage condition is not satisfied (the control terminal of the first transistor being subjected to a voltage substantially equal to $V_v$*R32/(R31+R32) able to turn it on) and that the seventh transistor is off if the voltage condition is satisfied (the control terminal of the first transistor being subjected to a voltage substantially equal to $V_v$ able to turn it off). The sixth transistor may be a bipolar transistor with short-circuited collector and base. The seventh transistor may be a bipolar transistor with the collector linked to the common point shared by the resistors R32 and R33.

By way of example, a regulator may be embodied in HF5 CMOS technology for which the breakdown voltage is about 15 volts. The general principle is to detect the voltage applied with respect to a threshold of 12.5 volts by a resistive bridge and a comparator, and to switch the regulating structure while maintaining normal operation if the voltage is below 12 volts and by dividing the voltage applied if it is greater than 12 volts. Thus, not only is the regulator protected against destruction in the event of an excessive supply voltage, but additionally the regulator continues to operate satisfactorily at a voltage above the breakdown voltage. The regulator is designed in such a way that none of its components prone to break down at about 15 volts are subjected to such a voltage.

A regulating process according to the invention provides a constant voltage for supplying consumer elements from a variable voltage $V_v$, in which process the variable voltage $V_v$ is compared with a reference voltage $V_{ref}$, the variable voltage $V_v$ is divided by a factor $k_1$, and the regulating element is supplied with an equal voltage $V_r$ either via the variable voltage $V_v$ or via the divided variable voltage $V_v/k_1$ by switching between the two voltages. The switching may be controlled as a function of the comparison in such a way that the regulating element is supplied with the variable voltage $V_v$ if a voltage condition is not satisfied and with the divided variable voltage $V_v/k_1$ if the voltage condition is satisfied. The variable voltage $V_v$ is prone to take values greater than those which the active components of the device are capable of supporting.

The invention also applies to the automobile field, and in particular to inflatable safety bags. Thus, it is possible to construct a regulator which supports a supply voltage greater than that normally permitted by the technology used. This exhibits numerous advantages in terms of choice of technology, reduction of the silicon area used and optimization. Indeed, in the case of an automobile, the regulator is normally supplied from a battery or an alternator operating at 12 volts. However, should the battery be unplugged, the output voltage from the alternator could reach much higher values. The electrical network of the vehicle is also subjected to radiation due to the high voltage used by the ignition spark plugs of the engine. As a result, a regulator mounted in an automobile must be able to support voltages of up to 25 volts.

BRIEF DESCRIPTION OF THE DRAWINGS

The present invention will be better understood upon studying the detailed description of the embodiment given by way of non-limiting example and illustrated by the appended drawings, in which.

DETAILED DESCRIPTION OF THE PREFERRED EMBODIMENTS

Figure 1:
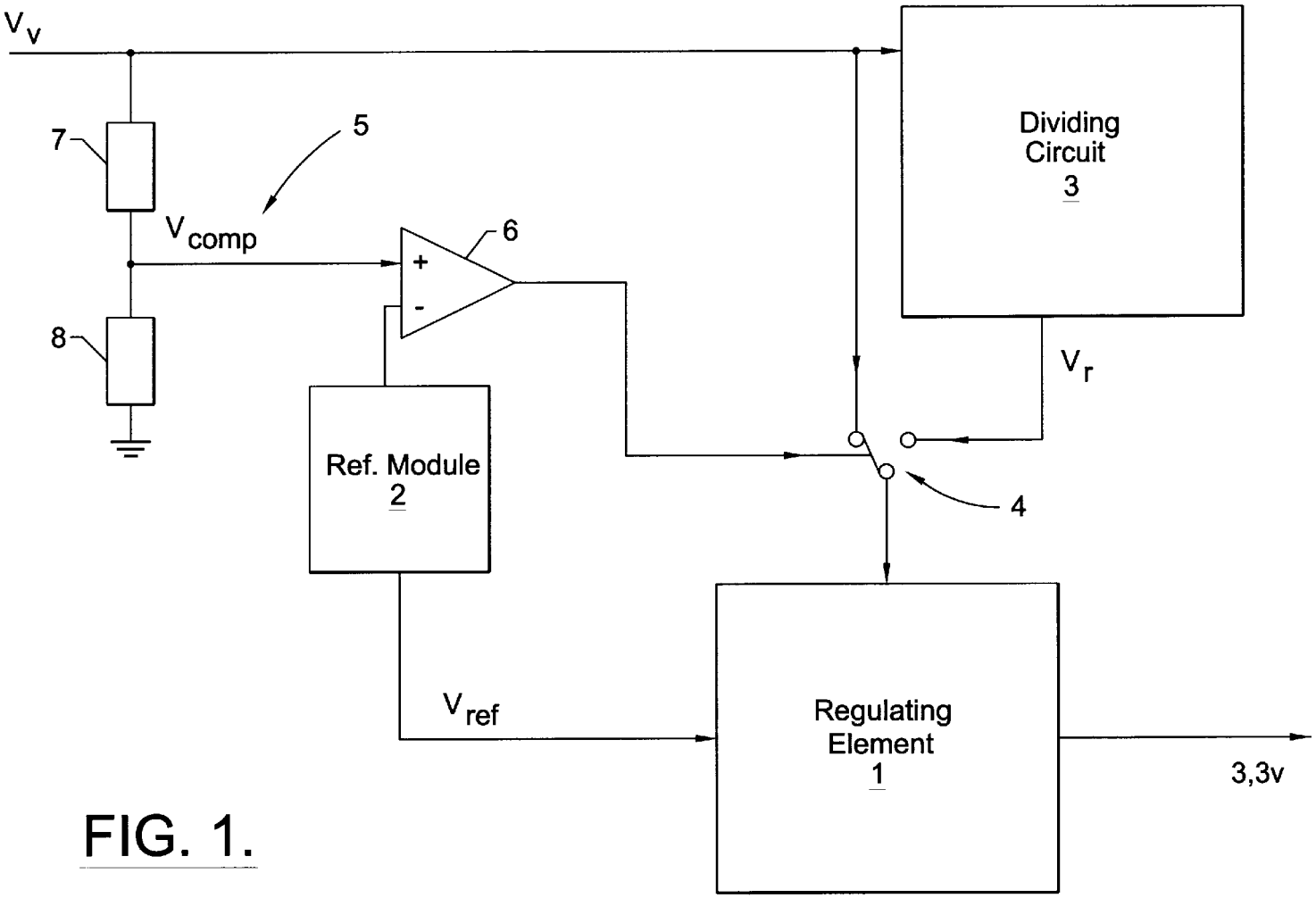
FIG. 1 is a schematic block diagram of a regulating device according to the present invention.

As may be seen in FIG. 1, a regulating device according to the present invention includes a regulating element 1 of a conventional type that is supplied with a DC voltage prone to vary between 5.1 and 12.5 volts and outputting a regulated voltage of 3.3 volts, for example. The regulating device also includes a reference module 2 which delivers a reference voltage to the regulating element, enabling it to formulate the regulated voltage.

The regulating device includes a means 3 for dividing the supply voltage $V_v$, which is between 5.1 and 25 volts, for example. The dividing means 3 may divide the supply voltage by two, for example. The regulating device also includes a switching means 4, of which one input is linked directly to the supply voltage $V_v$. Another input is linked to the output of the dividing means 3 and sees a voltage $V_r$ lying between 5.1 and 12.5 volts. The output supplies the regulating element 1 and a control input receives a setting originating from a comparison means 5. The comparison means 5 includes an amplifier 6 arranged as a comparator whose negative terminal receives a reference voltage $V_{ref}$ originating from the reference module 2, and whose positive terminal receives a voltage $V_{comp}$ proportional to the supply voltage $V_v$ by way of two resistors 7 and 8 arranged in series between the voltage supply lying between 5.1 and 25 volts and ground. The positive terminal of the amplifier 6 is linked to the common point between the two resistors 7 and 8. The output of the amplifier 6 is linked to the control input of the switching means 4.

In the case of FIG. 1, it may be seen that the switching means 4 supplies the regulating element 1 directly with the supply voltage $V_v$. This stems from the fact that the supply voltage $V_v$ is less than 12.5 volts. If the supply voltage is greater than 12.5 volts, the amplifier 6 outputs an opposite setting. The switching means 4 then supplies the regulating element 1 from the divided voltage $V_r$ delivered by the dividing means 3. Thus, the regulating element 1 still sees at its input a voltage of less than or equal to 12.5 volts, while the regulating device as a whole sees a supply voltage of less than or equal to 25 volts.

Figure 2:
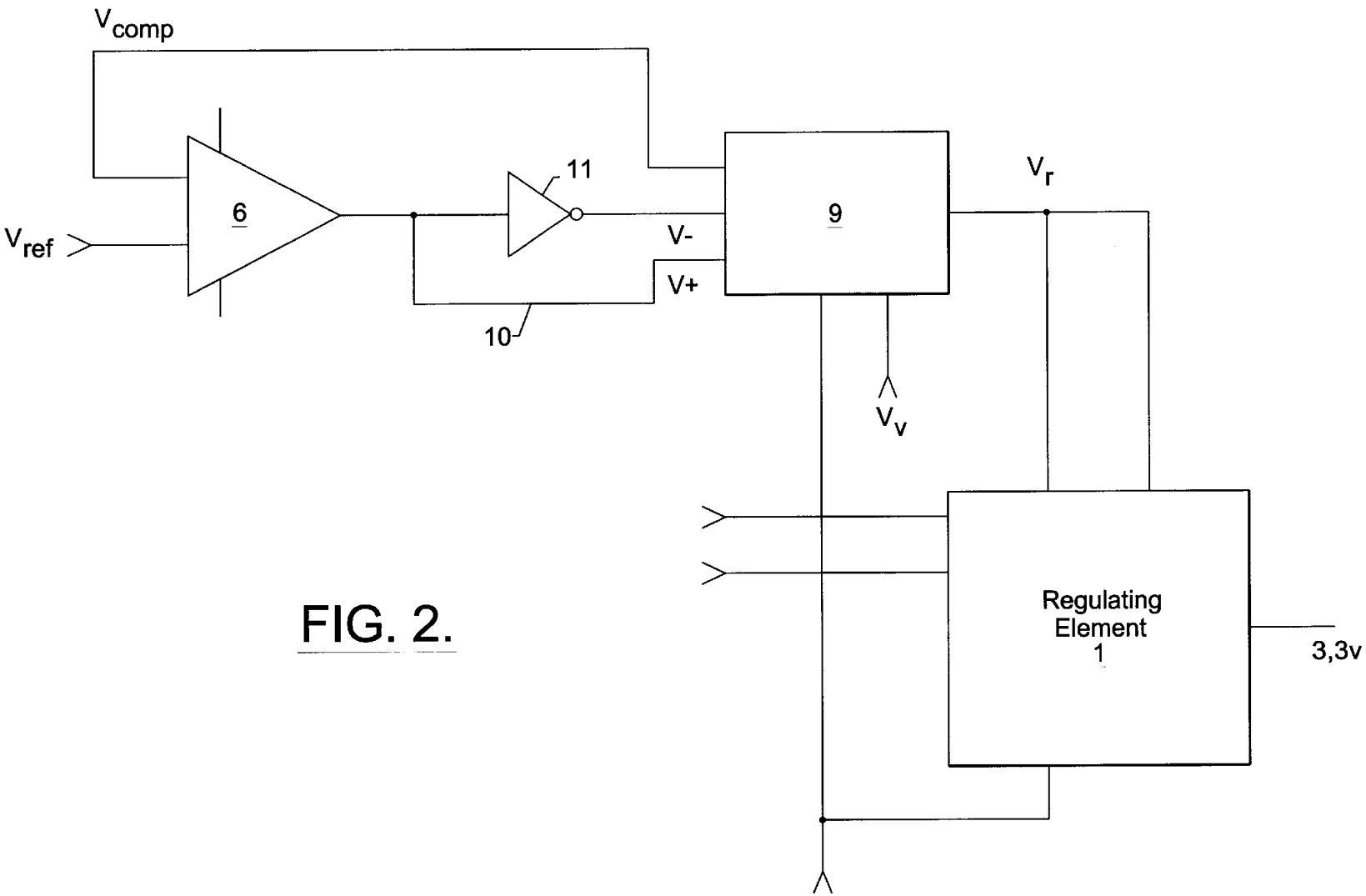
FIG. 2 is a schematic block diagram of the comparison means according to the present invention.

In FIG. 2, it may be seen that the module 9, which groups together the dividing means 3 and the switching means 4, is linked to the output of the amplifier 6 through which it receives a control signal $V_+$ from the conductor 10. The module 9 also receives an inverse control signal V_ obtained by an inverter 11 receiving as an input the control signal $V_+$. The comparison voltage $V_{comp}$ is delivered to the negative terminal of the amplifier 6 by the module 9. The resistors making it possible to obtain the comparison voltage $V_{comp}$ may also be integrated into the module 9. The module 9 is illustrated in detail in FIG. 3.

Figure 3:
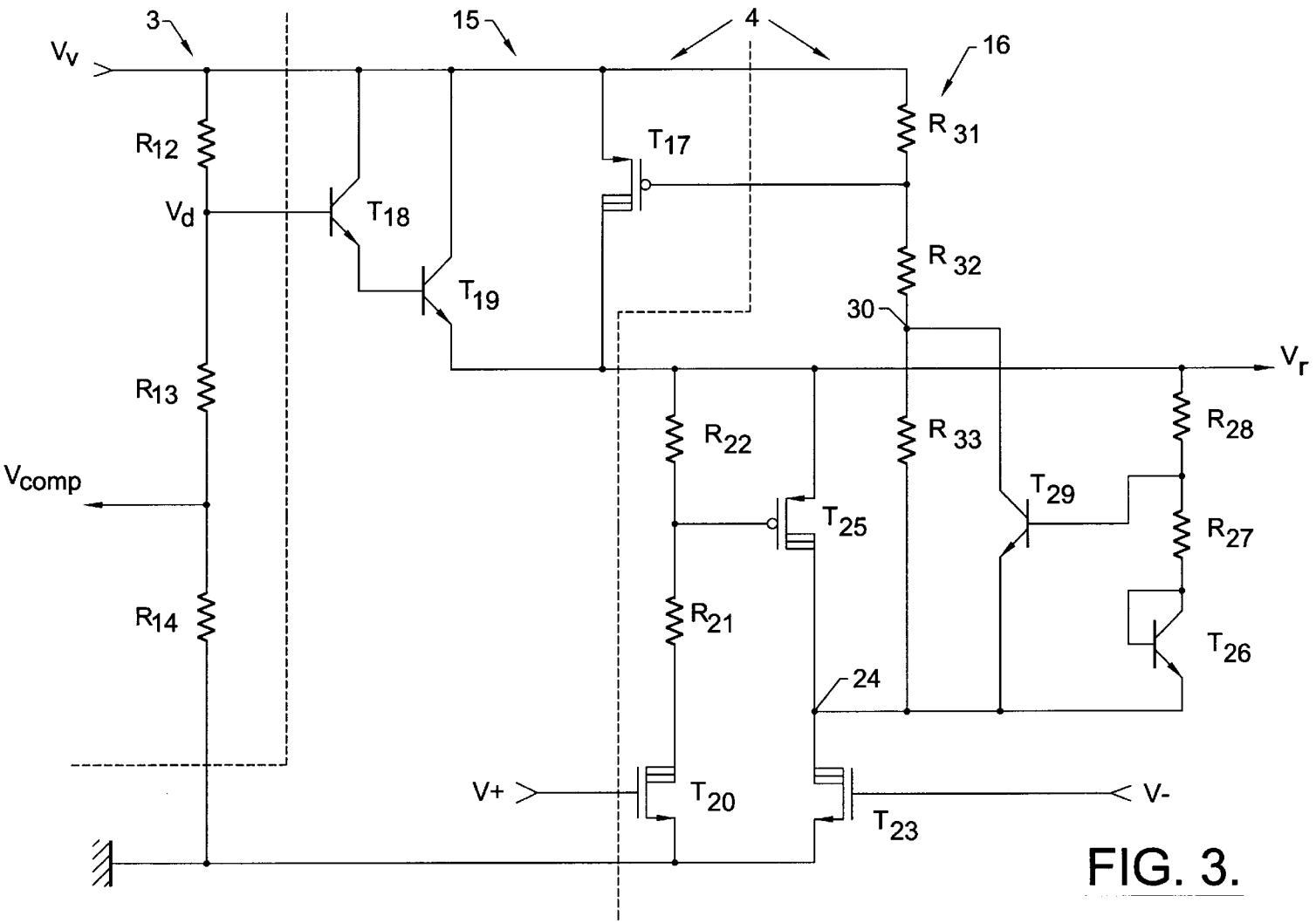
FIG. 3 is a schematic diagram of the switching means according to the present invention.

To aid understanding, the module 9 may be regarded as being divided into three parts possessing different functionalities, which are separated by dotted lines in FIG. 3 for convenience. The dividing means 3 is formed by three resistors R12, R13 and R14 connected in series between a line delivering the variable supply voltage $V_v$ (varying between 5.1 and 25 volts) and the ground line. It will be understood that the ground may be floating, i.e., the voltage $V_v$ is understood as taken with respect to ground.

The comparison voltage $V_{comp}$ is tapped off at the common point between the resistors R13 and R14 and a divided voltage $V_d$ is tapped off at the common point between the resistors R12 and R13. Therefore, $V_{comp}=V_v$*R14/(R12+R13+R14) and $V_d=V_v$*(R13+R14)(R12+R13+R14). Stated otherwise, $k_1$=(R13+R14)/(R12+R13+R14) and $k_2$=R14/(R12+R13+R14). By way of example, R12 may be equal to 55 kOhms, R13 may be equal to 45 kOhms and R14 may be equal to 25 kOhms, from which it follows that $V_{comp}$ is less than or equal to 5 volts and that $V_d$ is less than or equal to 14 volts.

The remainder of the module 9 forms the switching means 4 and can be divided into a switching part 15 and a switching control part 16. The switching part 15 includes a first MOS-type transistor T17. The sourse of the first transistor T17 is linked to the supply voltage $V_v$. The drain of the first transistor T17 is linked to the output of the module 9 which delivers a supply voltage $V_r$ of less than or equal to 12.5 volts to the regulating element 1 of FIG. 1. Furthermore, the gate of the first transistor T17 receives a control signal originating from the switching control part 16, which will be described below.

The switching part 15 also includes a second PNP bipolar type transistor T18 whose collector is linked to the supply line under the voltage $V_v$. The base of the second transistor T18 is linked to the common point shared by the resistors R12 and R13 and sees the voltage $V_d$. The emitter of the second transistor T18 is linked to an additional bipolar transistor T19 forming a cascode arrangement to be able to deliver a high output current under the voltage $V_r$. If the output current demanded is lower, the presence of the additional transistor T19 is not necessary. The transistor T19, of an NPN type, has its collector linked to the supply line under the voltage $V_v$, its base linked to the emitter of the transistor T18, and its emitter linked to the output line of the voltage $V_r$.

It may therefore be seen that if the transistor T17 is on $V_r$=$V_v$ and the two bipolar transistors T18 and T19 are short circuited and hence off. Conversely, if the transistor T17 is off, the voltage at the emitter of the transistor T19 is less than or equal to 12.5 volts. As soon as the difference between the voltages $V_d$ and $V_r$ becomes sufficient to turn on the transistors T18 and T19 (i.e., greater than or equal to 1.4 volts in general), the transistors T18 and T19 are turned on. One thus obtains a voltage $V_r$ equal to the voltage $V_d$ to within the base-emitter voltages of the transistors T18 and T19. More precisely, $V_r=V_d-V_{BET18}-V_{BET19}$. For example, if at this moment $V_v$=25 volts, $V_d$=14 volts and $V_r$ is substantially equal to 12.5 volts. To increase the breakdown voltage of the transistors T17, T18 and T19, they may be embodied in an insulated-well fashion. However, it should be noted that the maximum voltage which these transistors see is equal to $V_v-V_r$ and therefore does not exceed 12.5 volts.

The switching control part 16 serves to generate the control signal for the gate of the transistor T17 in such a way that the transistor T17 is off if the variable voltage $V_v$ is greater than 12.5 volts and is on in the other cases. The switching control part receives the control signal $V_+$ and the inverse control signal $V_-$ originating from the comparison means 5, illustrated in FIG. 1.

The switching control part 16 includes a MOS transistor T20 whose source is connected to ground, whose gate receives the control signal $V_+$, and whose drain is connected to the output line under the voltage $V_r$ by way of two resistors in series R21 and R22. The switching control part 16 may also include a MOS transistor T23, of the same type as above, whose source is linked to ground, whose gate receives the inverse control signal $V_-$, and whose drain is linked to a point 24. A MOS transistor T25 has its drain linked to the point 24, its source linked to the output line under the voltage $V_r$, and its gate linked to the common point between the resistors R21 and R22.

An NPN-type bipolar transistor T26 has its emitter linked to the point 24 and its base and its collector short circuited and linked to the output line at the voltage $V_r$ by two resistors R27 and R28. An NPN-type bipolar transistor T29 has its emitter linked to the point 24, its base linked to the common point between the resistors R27 and R28, and its collector linked to a point 30.

Three resistors in series, R31, R32 and R33, are disposed between the input line at the variable voltage $V_v$ and the point 24. The point 30 is the common point between the resistors R32 and R33. Stated otherwise, when it is on, the transistor T29 is able to short circuit the resistor R33. The common point between the resistors R31 and R32 is linked to the gate of the transistor T17 of the switching part 15 and therefore delivers the control signal to it.

The manner of operation of the switching control part 16 is as follows. If the voltage $V_v$ is greater than 12.5 volts, the transistor T20 receives a positive control signal $V_+$ which turns it on, while the transistor T23 receives a zero inverse control signal $V_-$ which turns it off. The gate of the transistor T25 is subjected to a voltage markedly less than the voltage $V_r$ on its source. To this end, R21 may be 150 kOhms and R22 may be 100 kOhms. The voltage at the point 24 is therefore equal to the supply voltage $V_r$ plus the almost zero voltage between the drain and the source of the transistor T25. The voltage between the base and the emitter of the transistor T26 is zero. The transistor T26 is off. The same holds for the transistor T29.

It follows that a current flows between the input line at the voltage $V_v$ and the point 24 by the resistors R31, R32 and R33. However, a small value is chosen for the resistor R31 relative to the resistor R33 (e.g., on the order of 10%) so that the voltage on the gate of the transistor T17 is high and very close to the variable voltage $V_v$. The transistor T17 is thus turned off. By way of example, R31 may be 30 kOhms, R32 may be 45 kOhms, and R33 may be 300 kOhms.

If the voltage $V_v$ is less than or equal to 12.5 volts, the manner of operation is as follows. The transistor T20 receives on its gate a zero control signal $V_+$ which turns it off, while the transistor T23 receives on its gate a positive inverse control signal $V_-$ which turns it on. The voltage at the point 24 is therefore substantially zero. The transistor T25 has its gate and its source substantially at the same potential and is therefore off. The transistor T26 is turned on by virtue of the current flowing from the output line at the voltage $V_r$ through the resistors R28 and R27. By reason of its arrangement, the transistor T26 behaves like a diode. It is therefore on as soon as the voltage $V_r$ becomes greater than 0.7 volts.

By way of example, identical values equal to 100 kOhms may be chosen for the resistors R27 and R28. The base of the transistor T29 is subjected to a voltage substantially equal to 0.7 volts plus half the difference between the voltage $V_r$ and 0.7 volts. Stated otherwise, the transistor T29 turns on as soon as the voltage $V_r$ exceeds 0.7 volts. The transistor T29 thus short circuits the resistor R33. The voltage at the point 30 is therefore close to zero. The voltage at the gate of the transistor T17 is substantially equal to $V_v$*R32/(R31+R32)= 0.4*$V_v$, this being sufficient to turn on the transistor T17 even if the voltage $V_v$ is getting close to its threshold of 5.1 volts. The transistor T17 then short circuits the bipolar transistors T18 and T19 which turn off.

On startup, even if the variable voltage $V_v$ is less than 12.5 volts, the bipolar transistors T18 and T19 of the cascode arrangement, which are not yet short circuited by the transistor T17, are naturally on. Thus, in the short interval of time between the application of the voltage $V_v$ and the switching of the transistor T17, the regulating device operates by dividing the supply voltage, thereby guaranteeing the safety of the regulating element 1.

By way of example, if, on startup, the regulating device receives a voltage $V_v$ equal to 10 volts, the base of the transistor T18 is subjected to a voltage on the order of 5.6 volts. It follows that the transistors T18 and T19 are conducting, thereby making it possible to have $V_r$ equal to about 4.2 volts on the output line. This causes biasing of the transistors T20, T23, T25, T26, T29 and the outputting of a control signal on the gate of the transistor T17 able to turn it on and to short circuit the transistors T18 and T19, in such a way that the voltage $V_r$ reaches 10 volts.

It may also be noted that the various transistors are not subjected to voltages above 15 volts. This is because the transistor T20 is between $V_r$ and ground and is subjected to a maximum of 12.5 volts. The transistor T23 between the point 24 and ground can be subjected to a voltage of slightly greater than 12.5 volts. It is in any event limited by the fact that the resistor R33 is of a high value and will therefore tend to limit the current passing through the transistor T25 when it is on. When it is off, the transistor T25 is subjected to the voltage $V_r$. When it is off, the transistor T26 is likewise subjected to the voltage $V_r$. When it is off, the transistor T29 is subjected to the voltage across the terminals of the resistor R33, which always remains less than the voltage difference between $V_v$ and $V_r$, and hence less than 12.5 volts.

Thus, the switching control means 16 is supplied, in general, with the voltage $V_r$ limited to a maximum of 12.5 volts, while being able to control the gate of the transistor T17 to a voltage of between 12.5 and 25 volts. By virtue of the invention, it is possible to embody a voltage regulator in integrated technology (e.g., HF5 CMOS, Bi-CMOS not supporting high voltages), while the regulator will be able to support markedly higher voltages, e.g., double.

Thus, it is possible to use economical integration technologies allowing high operating speeds while having a regulator which is compatible with a difficult environment prone to high overvoltages. It should be noted that it is possible to increase the speed of operation of the switching means by reducing the value of the resistors R31 and R32, in such a way that the gate capacitances of the MOS transistor T17 charge up more rapidly.

That which is claimed is:

1. A regulating device for receiving a variable voltage and delivering a constant voltage for supplying electrical devices, the device comprising:

a regulating element;

a comparison circuit for comparing the variable voltage with a reference voltage;

a dividing circuit for dividing the variable voltage to provide a divided variable voltage; and a switching circuit for supplying the regulating element with either the variable voltage or the. divided variable voltage, the switching circuit being controlled by the comparison circuit so that the regulating element is supplied with the variable voltage if a voltage condition is not satisfied and with the divided variable voltage if the voltage condition is satisfied, the variable voltage being prone to take values greater than those which active components of the electrical devices are capable of supporting.

2. The regulating device according to claim 1 wherein the comparison circuit comprises:

an additional dividing circuit for dividing the variable voltage by a comparison factor to obtain a comparison voltage, and an amplifier arranged as a comparator and receiving on one input thereof the comparison voltage and on another input thereof the reference voltage and outputting a control signal.

3. The regulating device according to claim 2 wherein the control signal is equal to a first logic level if the comparison voltage is greater than the reference voltage; and wherein the control signal is equal to a second logic level the comparison voltage is less than the reference voltage.

4. The regulating device according to claim 2 further comprising an inverter connected to an output of said amplifier providing an inverse control signal.

5. The regulating device according to claim 2 wherein said additional dividing circuit comprises at least two resistors connected in series between the variable voltage and ground.

6. The regulating device according to claim 5 wherein the dividing circuit comprises at least two resistors connected in series between the variable voltage and ground; and wherein said dividing circuit and said additional dividing circuit have at least one resistor in common.

7. The regulating device according to claim 1 wherein said switching circuit comprises:

a first transistor having a first terminal connected to an input of said switching circuit supplied with the variable voltage, a second terminal connected to an output of said switching circuit supplied with an output voltage of said dividing circuit, and a control terminal; and a control circuit connected to the control terminal of said first transistor for generating a voltage for turning on said first transistor if the voltage condition is not satisfied and turning off said first transistor if the voltage condition is satisfied.

8. The regulating device according to claim 7 wherein said switching circuit comprises a second transistor having a first terminal connected to the input of said switching circuit, a second terminal connected to the output of said switching circuit, and a control terminal supplied with a control voltage equal to the divided variable voltage for turning off said second transistor if the voltage condition is not satisfied and turning on said second transistor if the voltage condition is satisfied so that the output voltage of said dividing circuit is equal to the divided variable voltage.

9. The regulating device according to claim 7 wherein said control circuit comprises:

a third transistor controlled by an output voltage from said comparison circuit and having a first terminal connected to ground and a second terminal connected to the output of said switching circuit by first and second resistors connected in series, a common point shared by the first and second resistors being supplied with the output voltage of said dividing circuit if the voltage condition is not satisfied and a voltage equal to the product of the output voltage of said dividing circuit and the first resistor divided by a sum of the first and second resistors if the voltage condition is satisfied;

a fourth transistor controlled by an inverse output voltage from said comparison circuit and having a first terminal connected to ground and a second terminal; and a fifth transistor connecting the second terminal of said fourth transistor to the output of said switching circuit and having a control terminal connected to the common point shared by the first and second resistors, said fifth transistor being on if the voltage condition is satisfied and off if the voltage condition is not satisfied so that a common point shared by said fourth and fifth transistors is supplied with a voltage that is substantially zero if the voltage condition is not satisfied and substantially equal to the output voltage of the dividing circuit if the voltage condition is satisfied.

10. The regulating device according to claim 9 wherein said control circuit further comprises:

a sixth transistor having a first terminal connected to the common point shared by said fourth and fifth transistors and a second terminal and a control terminal short circuited and connected to the output of said switching circuit by third and fourth resistors connected in series, the sixth transistor being oh if the voltage condition is not satisfied and off if the voltage condition is satisfied, the common point shared by the third and fourth resistors being provided with a voltage equal to the product of the output voltage of said dividing circuit and the third resistor divided by a sum of the second and third resistors if the voltage condition is not satisfied and the output voltage of said dividing circuit if the voltage condition is satisfied; and a seventh transistor having a control terminal connected to the common point shared by the third and fourth resistors, a first terminal connected to the common point shared by said fourth and fifth transistors, and a second terminal connected to the common point shared by said fourth and fifth transistors by a fifth resistor, the second terminal of said seventh transistor also being connected to the control terminal of said first transistor of the switching circuit by a sixth resistor.

11. The regulating device according to claim 10 wherein the fifth resistor connects the control terminal of said first transistor and the input of said switching circuit so that said seventh transistor is on if the voltage condition is not satisfied and off if the voltage condition is satisfied.

12. The regulating device according to claim 10 wherein the control terminal of said first transistor is subjected to a voltage substantially equal to a product of the variable voltage and the sixth resistor divided by a sum of the fifth and sixth resistors for turning the first transistor on and a voltage substantially equal to the variable voltage for turning said first transistor off.

13. A voltage regulator comprising:

a regulating element;

a comparison circuit for comparing a variable voltage with a reference voltage;

a dividing circuit for dividing the variable voltage to provide a divided variable voltage; and a switching circuit for supplying the regulating element with either the variable voltage or the divided variable voltage, the switching circuit being controlled by the comparison circuit so that the regulating element is supplied with the variable voltage if a voltage condition is not satisfied and with the divided variable voltage if the voltage condition is satisfied.

14. The voltage regulator according to claim 13 wherein the comparison circuit comprises:

an additional dividing circuit for dividing the variable voltage by a comparison factor to obtain a comparison voltage, and an amplifier arranged as a comparator and receiving on one input thereof the comparison voltage and on another input thereof the reference voltage and outputting a control signal.

15. The voltage regulator according to claim 14 further comprising an inverter connected to an output of said amplifier providing an inverse control signal.

16. The voltage regulating device according to claim 14 wherein said additional dividing circuit comprises at least two resistors connected in series between the variable voltage and ground.

17. The voltage regulator according to claim 16 wherein the dividing circuit comprises at least two resistors connected in series between the variable voltage and ground; and wherein said dividing circuit and said additional dividing circuit have at least one resistor in common.

18. The voltage regulator according to claim 13 wherein said switching circuit comprises:

a first transistor having a first terminal connected to an input of said switching circuit supplied with the variable voltage, a second terminal connected to an output of said switching circuit supplied with an output voltage of said dividing circuit, and a control terminal; and a control circuit connected to the control terminal of said first transistor for generating a voltage for turning on said first transistor if the voltage condition is not satisfied and turning off said first transistor if the voltage condition is satisfied.

19. A method for regulating a variable voltage comprising:

comparing the variable voltage with a reference voltage;

dividing the variable voltage; and supplying a regulating element with either the variable voltage or the divided variable voltage by switching therebetween, the switching being controlled as a function of the comparison so that the regulating element is supplied with the variable voltage if a voltage condition is not satisfied and with the divided variable voltage if the voltage condition is satisfied.

20. The method according to claim 19 wherein comparing comprises:

connecting an additional dividing circuit for dividing the variable voltage by a comparison factor to obtain a comparison voltage, and connecting an amplifier as a comparator for receiving on one input thereof the comparison voltage and on another input thereof the reference voltage and outputting a control signal.

21. The method according to claim 20 further comprising connecting an inverter connected to an output of the amplifier providing an inverse control signal.

22. The method according to claim 20 wherein the additional dividing circuit comprises at least two resistors connected in series between the variable voltage and ground.

* * * * *